United States Patent [19]

Huschauer

[11] Patent Number: 5,003,931

[45] Date of Patent: Apr. 2, 1991

[54] METHOD OF AND DEVICE FOR MAINTAINING A PARAMETER CONSTANT IN A FLUIDIZED-BED FURNACE

[75] Inventor: Helmuth Huschauer, Neuss, Fed. Rep. of Germany

[73] Assignee: Vereinigte Kesselwerke AG, Düsseldorf, Fed. Rep. of Germany

[21] Appl. No.: 414,902

[22] Filed: Sep. 29, 1989

[30] Foreign Application Priority Data

Oct. 1, 1988 [DE] Fed. Rep. of Germany ..... 3833489

[51] Int. Cl.[5] ..... B09B 3/00

[52] U.S. Cl. ..... 122/4 D; 110/186; 110/190; 110/234

[58] Field of Search ..... 122/4 D; 431/7; 110/245, 347, 263, 204, 205, 165 R; 165/104.16; 422/139; 34/57 A; 432/15, 58

[56] References Cited

U.S. PATENT DOCUMENTS

| | | | |
|---|---|---|---|
| 4,419,965 | 12/1983 | Garcia-Mallol et al. | 110/245 |
| 4,421,036 | 12/1983 | Brännström et al. | 110/245 |
| 4,433,631 | 2/1984 | Lindahl | 110/245 |
| 4,442,797 | 4/1984 | Strohmeyer, Jr. | 110/245 |
| 4,733,619 | 3/1988 | Maeda et al. | 110/245 |
| 4,761,131 | 8/1988 | Abdulally | 110/245 |
| 4,790,267 | 12/1988 | Mollenhoff et al. | 110/245 |
| 4,796,568 | 1/1989 | Pillai | 110/245 |
| 4,813,479 | 3/1989 | Wahlgren | 122/4 D |

*Primary Examiner*—Edward G. Favors
*Assistant Examiner*—Denise L. F. Gromada
*Attorney, Agent, or Firm*—Max Fogiel

[57] ABSTRACT

A parameter, especially the temperature of the bed in a fluidized-bed furnace, is maintained constant by a regulator (24) positioned in a line (20) that supplies fluidizing air to a trap (15), through which solids that have been precipitated out of the flue gas are recirculated into the fluidized bed (5). The servo mechanism (23) that drives the regulator is coupled to a temperature sensor (27) in the bed such that the volume of fluidizing air is increased when the measured bed temperature exceeds a prescribed level and decreased when it drops below that level.

4 Claims, 3 Drawing Sheets

METHOD OF AND DEVICE FOR MAINTAINING A PARAMETER CONSTANT IN A FLUIDIZED-BED FURNACE

The invention concerns a method of and a device for maintaining a parameter, especially the temperature of the bed, constant in a fluidized-bed furnace with the characteristics recited in the preambles to Claims 1 and 3.

A fluidized-bed furnace of this type is known from Technische Mitteilungen, 1984, 298–300 for example. Its load can be varied by varying the volumetric flow of fuel and air. Varying the volumetric flow of fuel directly affects the temperature of the bed. The output of the heating-surface sections downstream of the bed and of the empty space in the flow of flue gas can be varied by varying the bed temperature over time and by varying the volumetric flue-gas flow. The bed temperature can also fluctuate within certain limits at a constant load on the steam generator due to different burnouts for example. A constant bed temperature, however, is desirable not only for reasons of process and stoking engineering but also from the aspect of emissions.

Some furnaces have a circulating bed (VBG Kraftwerkstechnik 67 [1987], 437–443), and cooling some of the circulating solids in external coolers and returning them mixed with hot solids to the furnace in order to regulate the temperature of the bed is known. This is done with a trap that is subjected to air to fluidize its contents The trap is fluidized with a constant volume of air that is above the loosening point.

The flue gas and the solids it contains are cooled by convective heating surfaces in a low-expanded fluidized bed. The precipitated and cooled solids lower the temperature of the bed, which can accordingly be affected by how much solids are returned to the bed.

The object of the invention is simple means of maintaining a parameter, especially the temperature of the bed, constant in a furnace with a low-expanded fluidized bed into which the cooler solids are returned.

This object is attained in accordance with the invention by the method recited in Claim 1 and by the device recited in Claim 3. An advantageous embodiment of the invention that relates to bed temperature is recited in Claim 2.

It has been demonstrated that the volume of solids extracted from the trap almost equals the volume of fluidizing gas at speeds above the dissolution speed. The volume of gas is accordingly exploited as an input variable for compensating variations in the control parameter. The invention is especially appropriate for maintaining bed temperature constant. The results of different solids temperatures do not affect bed temperature.

Figure 1:
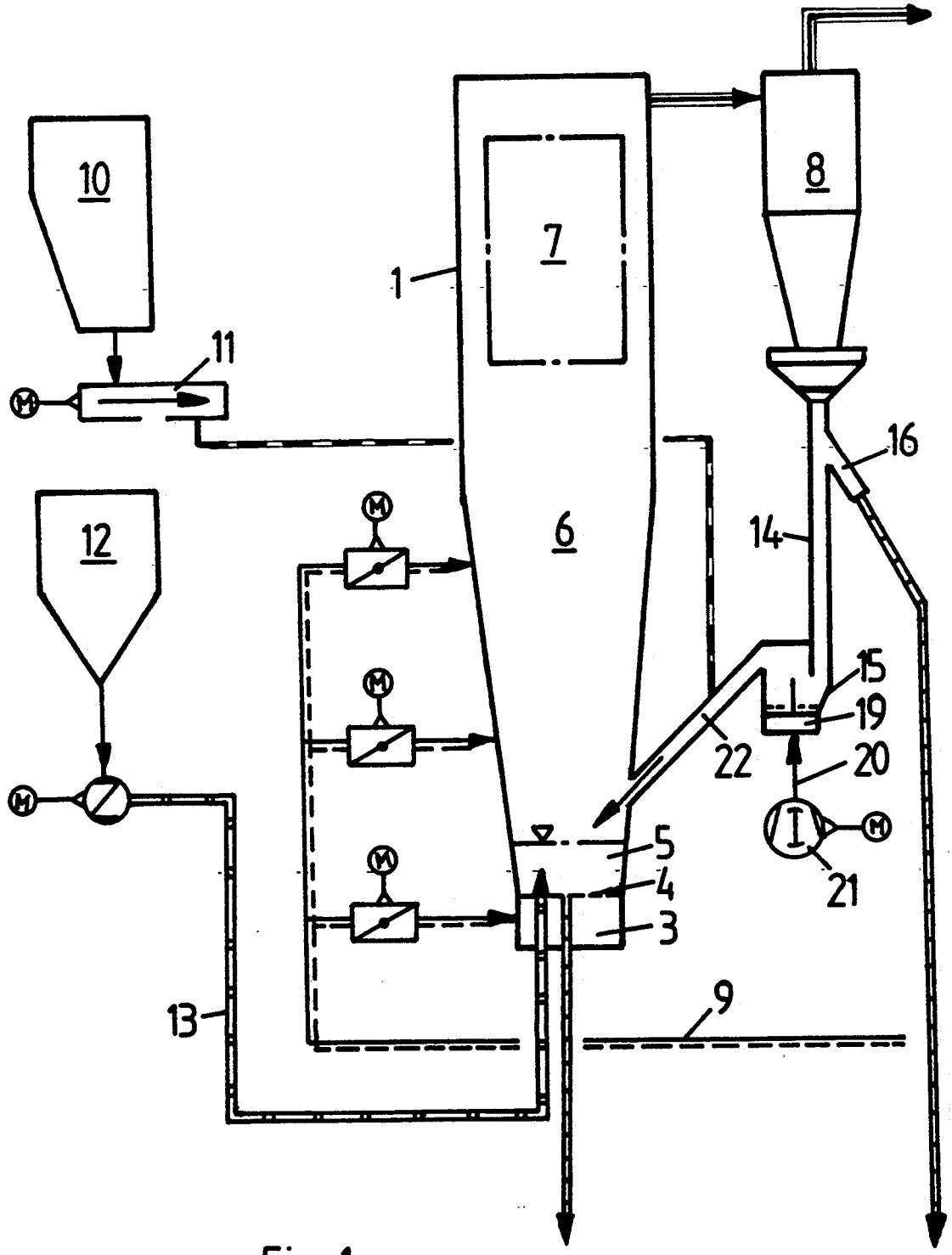
Figure 2:
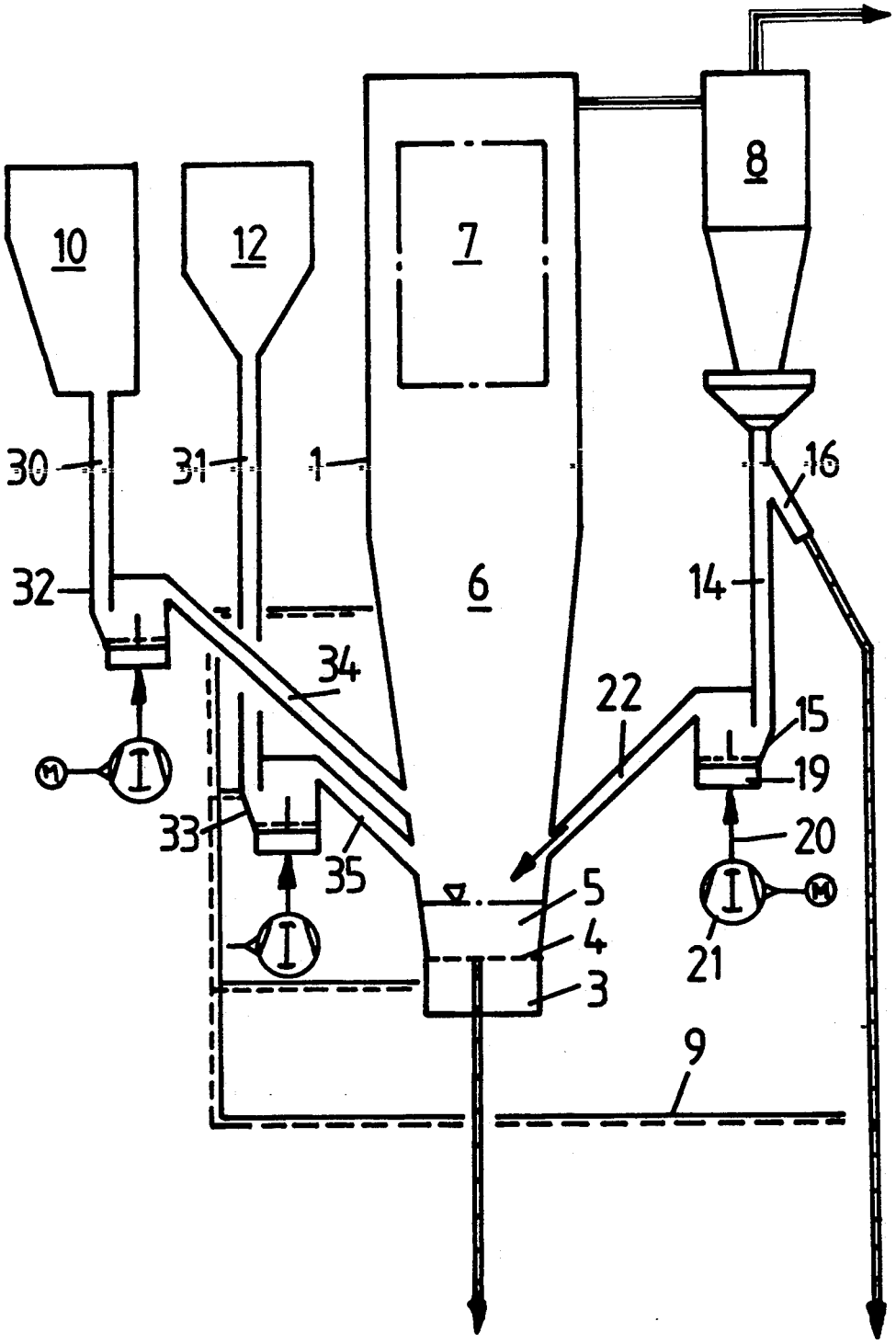
Figure 3:
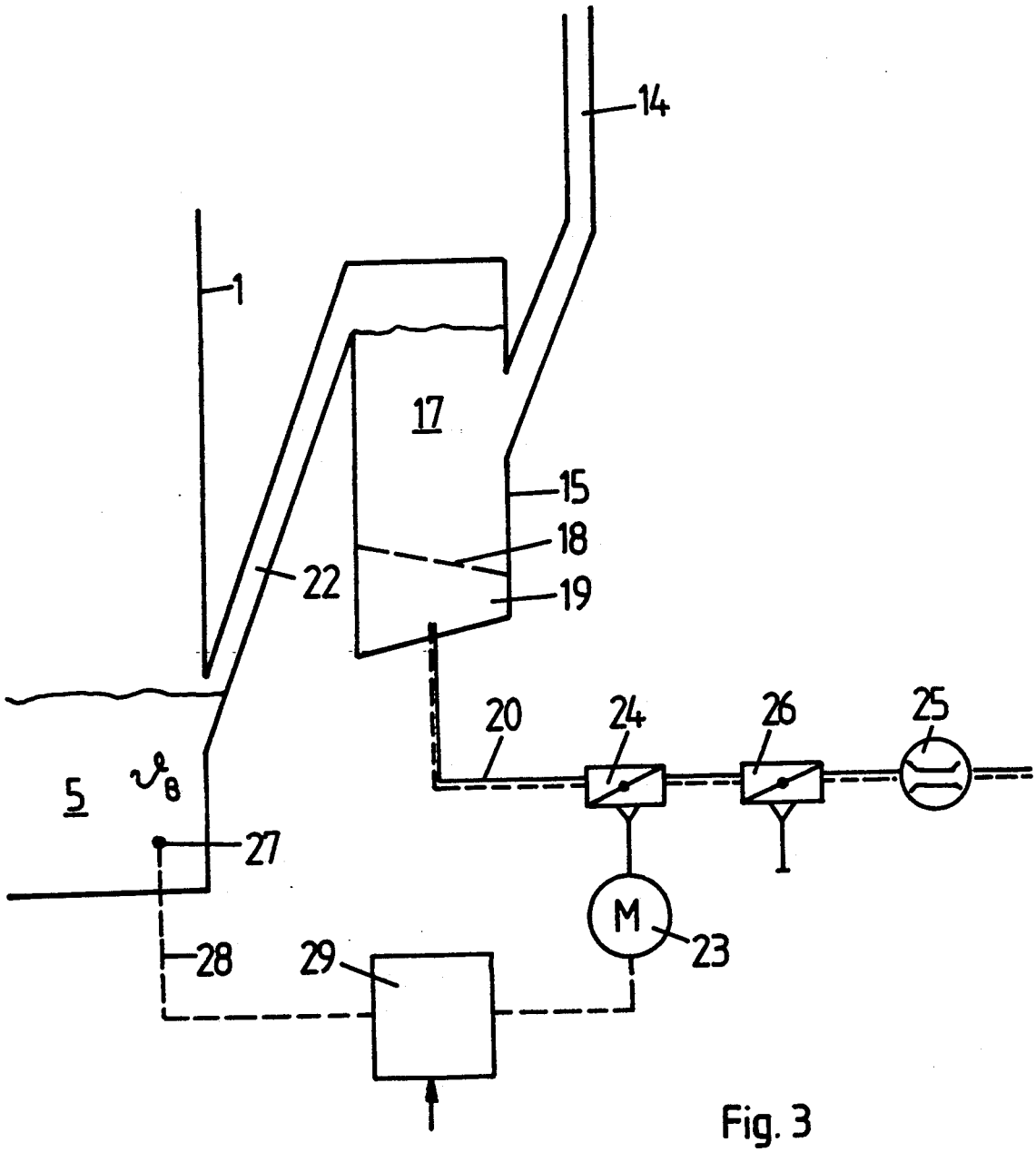

Several embodiments of the invention will now be described with reference to the drawings, wherein FIG. 1 is a flow diagram of a furnace with a low-expanded fluidized bed, FIG. 2 is a flow diagram of a furnace with a low-expanded fluidized bed and a different raw-material input, and FIG. 3 is a diagram illustrating how the bed temperature is controlled.

A furnace heats a steam generator, one boiler flue 1 of which is illustrated. Flue 1 communicates with one or more additional flues that accommodate downstream heating surfaces. The walls of boiler flue 1 consist of pipes welded together gas-tight and operating as evaporators. The flue comprises, from bottom to top, an air box 3, a nozzle floor 4, a stationary, low-expanded fluidized bed 5, and an empty space 6. Fluidized bed 5 and empty space 6 constitute the furnace's combustion space. The rate of fluidization in the combustion space is 3 to 5 m/sec, which is high enough to extract particles of moderate size (approximately 0.5 mm) from fluidized bed 5.

Above empty space 6 are convective surfaces 7 with superheating, economizer, and evaporator pipes. The temperature of the flue gas at the top of boiler flue 1 ranges between 300° and 500° C., depending on the application. The gas at this temperature arrives in cyclone precipitators 8, only one of which is illustrated in FIG. 1. The precipitators separate the solids entrained in the gas from the gas, return the solids to fluidized bed 5, and cool the bed.

Preheated air is supplied by way of a line 9 and divided into primary and secondary air. The primary air is injected into air box 3, and travels through the nozzles in floor 4 to fluidize bed 5. The secondary air travels through nozzles, preferably on two levels, into the empty space 6 above fluidized bed 5.

The fuel is unprocessed coal milled to a maximum particle size and temporarily stored in one or more hoppers 10. As will be evident from FIG. 1, the coal is removed from hopper 10 by way of a distributor 11 and introduced into the fluidized bed 5 inside boiler flue 1 either by way of belt chargers or in conjunction with the solids precipitated out in cyclone precipitator 8. Lime for desulfurization is stored in another hopper 12 and metered into the bottom of fluidized bed 5 through an infeed system 13.

The solids outlet of cyclone precipitator 8 communicates with a riser 14 that opens into the top of a trap 15. The precipitated solids clog up and seal off riser 14. The riser also stores the solids, ensuring that trap 15 will always have enough available to cool the bed in the event of a sudden increase in load. At the top of riser 14 is an overflow 16 that limits the level of solids in riser 14.

Trap 15 consists of a turbulence chamber 17 separated from an air chamber 19 by a nozzle floor 18. An intake line 20 communicates with air chamber 19, and air is pumped through the line and into air chamber 19 by a fan 21. The air fluidizes the solids in turbulence chamber 17. A shaft 22 communicates with the top of turbulence chamber 17 and opens into boiler flue 1 in the vicinity of fluidized bed 5. The fluidized solids flow over fluidized bed 5 through shaft 22, entraining the solids that clog up riser 14 into the turbulence chamber 17 in trap 15. How much of the solids flows out depends on how much air supplied to trap 15. Another gas, flue gas for example, can be employed instead of air to fluidize the bed.

The volume of fluidizing air injected into trap 15 is established by regulator 24 provided with a servo motor and sensed by a constriction flowmeter 25. Regulator 24 and flowmeter 25 are located in intake line 20. Upstream of regulator 24 is a trimming flap 26 that can be adjusted to ensure that the whole system is uniformly supplied with air when several cyclone precipitators 8 and traps 15 are employed together.

Fluidized bed 5 contains a sensor 27 for determining its temperature. The sensor is connected by an electric line 28 to controls 29 that activate the servo motor 23 that drives regulator 24. This circuit maintains the temperature of fluidized bed 5 constant, independent of load, with the volume of air supplied to trap 15 representing the input variable. When sensor 27 detects that the temperature of fluidized bed 5 exceeds a prescribed level, controls 29 open regulator 24, increasing the amount of solids entrained by the increased flow of air into the bed. The cooler recirculated solids cool the bed, and its temperature will drop back to the prescribed level. When the temperature of fluidized bed 5 drops below the prescribed level, regulator 24 will analogously restrict the flow of air, reducing the volume of solids supplied to the bed. The bed temperature will correct itself to the prescribed level as a result of the decrease in cooling.

The furnace illustrated in FIG. 2 is identical with the one illustrated in FIG. 1 except for the supply of coal and lime from hoppers 10 and 12. Each hopper 10 and 12 communicates by way of a riser 30 and 31 with a separate trap 32 and 33, which communicate in turn with boiler flue 1. Traps 32 and 33 operate like the trap 15 that controls the recirculation of solids as described with reference to FIGS. 1 and 3. The volume of fluidizing gas supplied to the trap 32 associated with coal-supply hopper 10 represents the input variable for one parameter of the steam generated in the steam generator. This parameter, which represents the control parameter, is steam pressure in a free-circulation steam generator and the temperature of the fresh stem in a forced-circulation steam generator. The trap 33 that governs the supply of lime similarly establishes and maintains constant the level of sulfur dioxide in the flue gas. The flow diagram is similar to FIG. 3, with the exception that temperature sensor 34 is replaced by a sulfurdioxide sensor positioned in the stream of flue gas.

I claim:

1. A method for maintaining a parameter constant in a fluidized-bed furnace, comprising the steps: supplying solids through a trap; supplying a fluidizing gaseous medium to said trap; fluidizing said solids by said gaseous medium; measuring said parameter; adjusting the volume of said gaseous medium dependent on said measuring step for increasing the volume of said gaseous medium when the parameter measured exceeds a predetermined magnitude and decreasing the volume of said gaseous medium when the parameter measured is below said predetermined magnitude.

2. A method as defined in claim 1, wherein said parameter comprises bed temperature, said fluidized-bed furnace having a low-expanded fluidized bed; generating a flue gas entraining solids in said fluidized bed; separating said solids from said flue gas and recirculating said solids to the bed through a trap, said solids being fluidized by said gaseous medium in said trap, the volume of gaseous medium supplied to said trap being dependent on the bed temperature measured so that the volume of gaseous medium is increased when the measured bed temperature exceeds said predetermined magnitude and is decreased when the measured bed temperature drops below said predetermined magnitude.

3. An arrangement for maintaining a parameter constant in a fluidized-bed furnace, comprising: means for supplying solids through a trap; means for supplying a fluidizing gaseous medium to said trap; said solids being fluidized by said gaseous medium in said trap; means for measuring said parameter; means for adjusting the volume of said gaseous medium dependent on measured results from said measuring means for increasing the volume of said gaseous medium when the parameter measured exceeds a predetermined magnitude and decreasing the volume of said gaseous medium when the parameter measured is below said predetermined magnitude.

4. An arrangement for maintaining temperature of a fluidized bed constant in a fluidized-bed furnace for heating a steam generator comprising: a boiler flue with a flue gas exit for conducting a flue gas generated in said fluidized bed, said boiler flue containing said furnace and heating surfaces; at least one cyclone precipitator downstream from said flue gas exit for separating solids from said flue gas; a riser with a trap and having a supply line for supplying fluidizing gas to said trap; said precipitator having a solids outlet communicating with said furnace through said riser for feeding back to said bed at least part of said solids after separation from said flue gas; temperature sensing means in said bed; regulator means with servo drive means in said supply line; and means for intercoupling said temperature sensor and said servo drive means for opening said regulator means when the bed temperature increases and closing said regulator means when the lead temperature decreases.

* * * * *